US008438703B2

(12) United States Patent
Tagtow et al.

(10) Patent No.: US 8,438,703 B2
(45) Date of Patent: May 14, 2013

(54) POSITIONABLE HINGE

(75) Inventors: Gary E. Tagtow, Sioux Falls, SD (US); Tracy Lammers, Sioux Falls, SD (US); Matthew L. Halbersma, Harrisburg, SD (US); Allen Rickenbaugh, Sioux Falls, SD (US); Matt Coplan, Harrisburg, SD (US); Eric J. Adamson, Tea, SD (US)

(73) Assignee: Amesbury Group, Inc., Amesbury, MA (US)

( * ) Notice: Subject to any disclaimer, the term of this patent is extended or adjusted under 35 U.S.C. 154(b) by 0 days.

(21) Appl. No.: 13/157,792

(22) Filed: Jun. 10, 2011

(65) Prior Publication Data

US 2012/0311816 A1 Dec. 13, 2012

(51) Int. Cl.
*E05D 11/10* (2006.01)

(52) U.S. Cl.
USPC ..... 16/334; 16/276; 16/330

(58) Field of Classification Search ..... 16/334, 16/344, 329–332, 352, 345, 312–318
See application file for complete search history.

(56) References Cited

U.S. PATENT DOCUMENTS

| | | | | |
|---|---|---|---|---|
| 405,931 | A | 6/1889 | Warner | |
| 542,051 | A * | 7/1895 | Heller | 292/213 |
| 622,321 | A | 4/1899 | Bersted | |
| 727,697 | A | 5/1903 | Sargent | |
| 759,890 | A | 5/1904 | Hubbard | |
| 943,807 | A | 12/1909 | Bommer | |
| 975,097 | A * | 11/1910 | Wright | 16/330 |
| 1,207,270 | A * | 12/1916 | Braithwaite | 16/329 |
| 1,241,082 | A | 9/1917 | Bommer | |
| 1,294,044 | A * | 2/1919 | Buckwalter et al. | 16/351 |
| 1,356,660 | A * | 10/1920 | Rowley | 403/158 |
| 1,612,462 | A * | 12/1926 | Mumford | 16/351 |
| 1,687,174 | A * | 10/1928 | Mountford et al. | 16/334 |
| 2,587,818 | A | 3/1952 | Caldwell et al. | |
| 2,635,281 | A * | 4/1953 | Feldberg | 16/276 |
| 2,729,473 | A * | 1/1956 | Warshawsky | 285/153.1 |
| 2,993,226 | A | 7/1961 | Baker, Jr. et al. | |
| 3,346,910 | A | 10/1967 | Dickinson et al. | |
| 3,401,422 | A | 9/1968 | Ventura | |
| 3,599,275 | A * | 8/1971 | Granzow | 16/275 |
| 4,501,045 | A * | 2/1985 | Boyer | 16/331 |
| 4,718,127 | A * | 1/1988 | Rittmann et al. | 2/424 |
| 4,829,633 | A * | 5/1989 | Kassner | 16/322 |
| 4,991,259 | A | 2/1991 | Finkelstein et al. | |
| 5,104,161 | A * | 4/1992 | Kautt | 292/157 |
| 5,127,132 | A | 7/1992 | Karlin | |
| 5,233,726 | A | 8/1993 | Cress | |
| 5,355,557 | A | 10/1994 | Cress et al. | |
| 5,355,559 | A | 10/1994 | Bowers et al. | |
| 5,412,842 | A * | 5/1995 | Riblett | 16/334 |

(Continued)

FOREIGN PATENT DOCUMENTS

| | | | |
|---|---|---|---|
| JP | 10105814 | A * | 4/1998 |
| JP | 2002295112 | A * | 10/2002 |

*Primary Examiner* — Chuck Y. Mah
(74) *Attorney, Agent, or Firm* — Merchant & Gould P.C.

(57) ABSTRACT

A positionable hinge includes a first section and a second section. The first section includes a first leaf and a first hinge barrel secured thereto. The first hinge barrel has a first barrel surface. The second section also includes a second leaf and a second hinge barrel secured thereto. Each of the first and second barrel have barrel surfaces at an interface. These barrel surfaces are opposed textured mating surfaces that allow the hinge to be held in place in any desired position.

13 Claims, 7 Drawing Sheets

U.S. PATENT DOCUMENTS

| | | | | |
|---|---|---|---|---|
| 5,472,271 | A | 12/1995 | Bowers et al. | |
| 6,036,050 | A * | 3/2000 | Ruane | 220/831 |
| 6,049,946 | A | 4/2000 | Cress et al. | |
| 6,058,564 | A | 5/2000 | Purcell et al. | |
| 6,282,752 | B1 * | 9/2001 | Kluting et al. | 16/334 |
| 6,807,711 | B2 | 10/2004 | Lu | |
| 7,096,536 | B2 * | 8/2006 | Johnson | 16/300 |
| D532,280 | S | 11/2006 | Huml | |
| 7,493,675 | B2 * | 2/2009 | Lin et al. | 16/330 |
| 7,603,746 | B1 | 10/2009 | Von Resch et al. | |
| 2002/0194703 | A1 | 12/2002 | Cress et al. | |
| 2003/0101539 | A1 | 6/2003 | Fang | |
| 2004/0020011 | A1 | 2/2004 | Fang | |
| 2004/0068840 | A1 | 4/2004 | Thomas et al. | |
| 2005/0055805 | A1 | 3/2005 | Hsu et al. | |
| 2005/0188499 | A1 | 9/2005 | Heid | |
| 2005/0188500 | A1 | 9/2005 | Heid | |
| 2005/0193521 | A1 | 9/2005 | Heid | |
| 2005/0246863 | A1 | 11/2005 | Chesworth et al. | |
| 2005/0273977 | A1 | 12/2005 | Lu et al. | |
| 2006/0179610 | A1 | 8/2006 | Erickson et al. | |
| 2007/0101541 | A1 | 5/2007 | Yin et al. | |
| 2008/0141491 | A1 | 6/2008 | Heid | |
| 2008/0148516 | A1 | 6/2008 | Heid | |
| 2008/0184527 | A1 | 8/2008 | Chao | |
| 2008/0184528 | A1 | 8/2008 | Chao | |
| 2008/0184530 | A1 | 8/2008 | Chao | |
| 2008/0184531 | A1 | 8/2008 | Chao | |
| 2008/0209679 | A1 | 9/2008 | Erickson et al. | |
| 2009/0007378 | A1 | 1/2009 | Guo et al. | |
| 2009/0056073 | A1 | 3/2009 | Lin | |
| 2009/0133223 | A1 | 5/2009 | McAfee | |
| 2010/0242227 | A1 | 9/2010 | Tagtow et al. | |
| 2010/0313483 | A1 | 12/2010 | Waddell | |

* cited by examiner

POSITIONABLE HINGE

INTRODUCTION

Hinges are used to move pivoting elements, such as windows and doors, between a closed position and a selected open position. Often, however, the moved window or door (commonly referred to as a panel), may continue to pivot to a different position due to a skewed panel or panel frame (i.e., a window frame or door frame) or other structural condition. Additionally, the panel may also move when acted upon inadvertently by an outside force, such as a gust of wind or a pet brushing against the panel. To minimize further pivoting, a hinged panel may be partially secured by casement hardware (in the case of a window) or a door stop (in the case of a door). These pivot limiting devices may be unsightly or require additional hardware.

SUMMARY

In one aspect, the technology relates to a hinge including: a first section having: a first leaf; and a first hinge barrel secured to the first leaf, the first hinge barrel having a first barrel surface; and a second section having: a second leaf; and a second hinge barrel secured to the second leaf, the second hinge barrel having a second barrel surface, wherein the first barrel surface and the second barrel surface include opposed textured mating surfaces. In an embodiment, the first section includes a first bushing having a first textured mating surface. In another embodiment, the second section includes a second bushing having a second textured mating surface. In another embodiment, the hinge includes a hinge pin, wherein the hinge pin is located substantially within the first hinge barrel and the second hinge barrel and defines a pivot axis. In yet another embodiment, the opposed textured mating surfaces are positioned off of the pivot axis. In still another embodiment, at least one of the opposed textured mating surfaces includes at least one of a spherical cap, a hemisphere, a pyramid, a cone, a cylinder, a frustum, a portion of a torus, and a portion of a prism. In another embodiment, at least one of the opposed textured mating surfaces includes a serration or a crenellation or a spring-biased projection.

In another aspect, the technology relates to a bushing system including: a first bushing including a first side and a second side and at least one projection extending from the first side; and a second bushing including a third side and a fourth side, wherein the fourth side includes at least one indentation. In an embodiment, the projection and the indentation are adapted to mate when the bushings are installed in a hinge. In another embodiment the at least one projection and the at least one indentation each include at least a portion of a serrated surface or a crenellated surface.

In another aspect, the technology relates to a hinge including: a first section having a first means for fixing a position of the first section; and a second section having a second means for fixing a position of the first section, wherein a position of the first section is fixed upon an engagement of the first means and the second means. In another embodiment, the first means is at least one of a spherical cap, a hemisphere, a pyramid, a cone, a cylinder, a frustum, a portion of a torus, and a portion of a prism, and wherein the second means is an indentation. In yet another embodiment, the first means and the second means each are substantially similar serrated surfaces, or substantially similar crenellated surfaces.

BRIEF DESCRIPTION OF THE DRAWINGS

There are shown in the drawings, embodiments which are presently preferred, it being understood, however, that the technology is not limited to the precise arrangements and instrumentalities shown.

DETAILED DESCRIPTION

Figure 1:
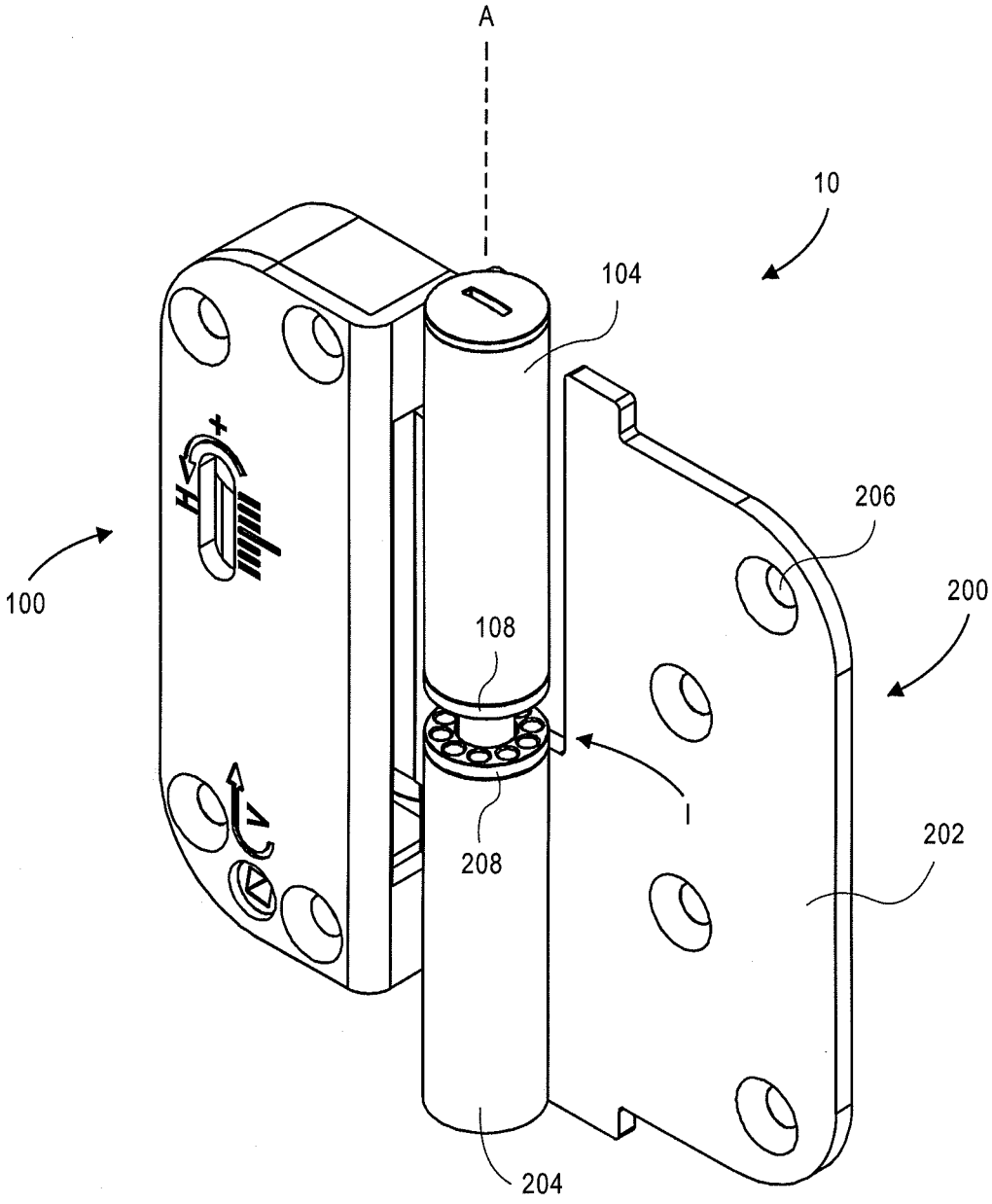
FIG. 1 is a perspective view of a positionable hinge.
Figure 2:
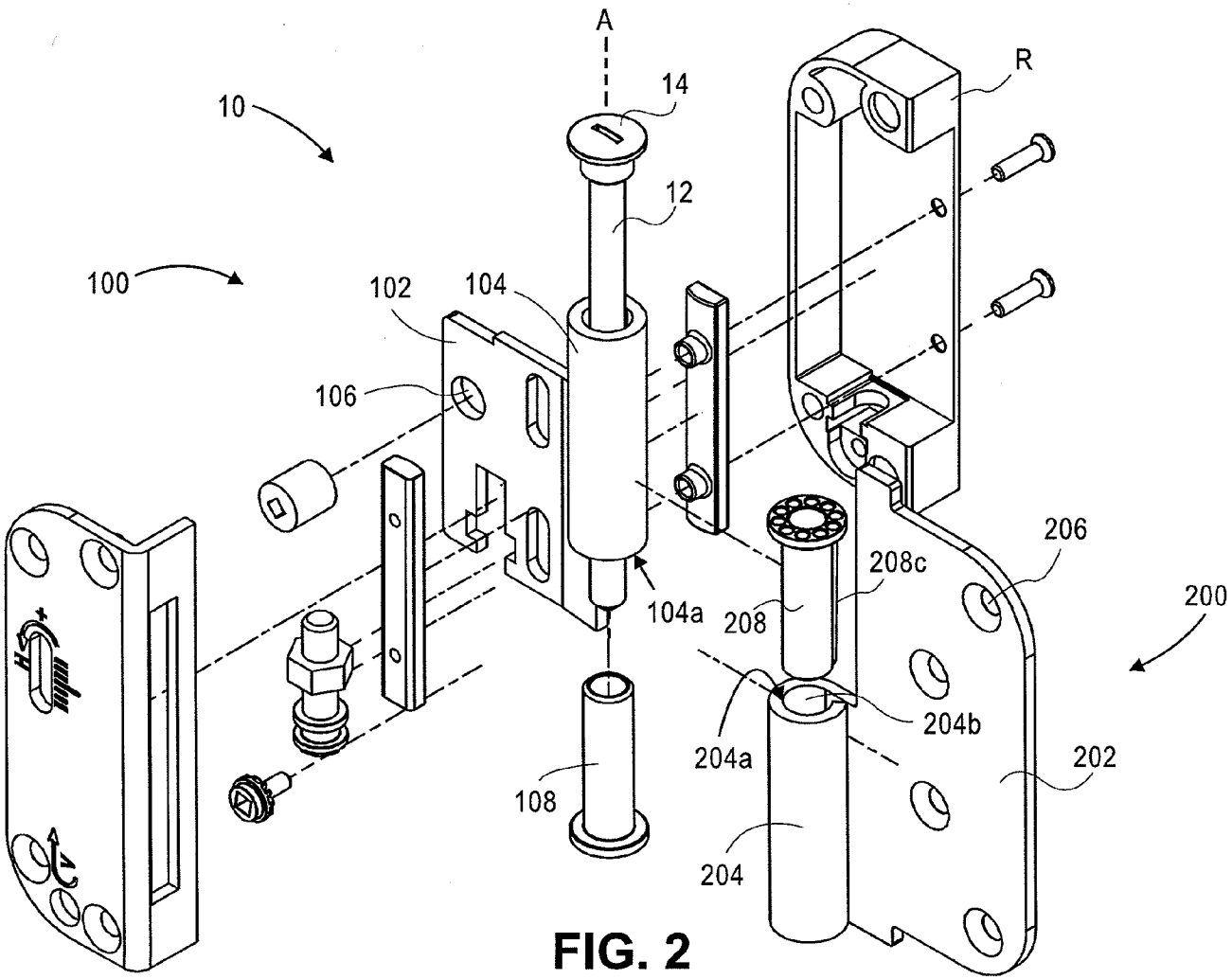
FIG. 2 is an exploded perspective view of the positionable hinge of FIG. 1.

FIGS. 1 and 2 depict a positionable hinge 10. The hinge 10 includes two sections 100, 200. In the depicted embodiment, the first section 100 is an upper section and the second section 200 is a lower section. Each section 100, 200, includes a leaf 102, 202 and a hinge barrel 104, 204. Each leaf 102, 202 defines one or more openings 106, 206. In the depicted embodiment, the openings 106 in the first leaf 102 may be used to moveably secure the leaf 102 within an adjustable hinge receiver R. The openings 206 may be used to secure the leaf 202 to a respective panel or jamb with screws, bolts, or other fasteners. Additional elements of an adjustable hinge, such as that depicted in FIG. 2, are described in U.S. Published Patent Application No. 2010/0242227, the disclosure of which is hereby incorporated by reference herein in its entirety. A pin 12 pivotably secures the two sections 100, 200, at their respective hinge barrels 104, 204. The pin 12 is substantially aligned with the pivot axis A formed by each hinge barrel 104, 204. The pin 12 may include a cap 14 to prevent fall-out of the pin 12, or locking caps may be used with a capless pin to secure the pin in place to prevent fall-out or back-out thereof. Each barrel 104, 204 may also include a bushing 108, 208 located at the barrel interface I. The second bushing 208 may include a keyway 208*c* configured to mate with a slot 204*b* on the second barrel 204. A similar keyway is located on the first bushing 108. This configuration aids in aligning the projections 110 and indentations 112 described below. The barrel interface I comprises opposed textured mating surfaces, whether or not bushings are utilized, to hold the hinge in a desired position.

Figure 3:
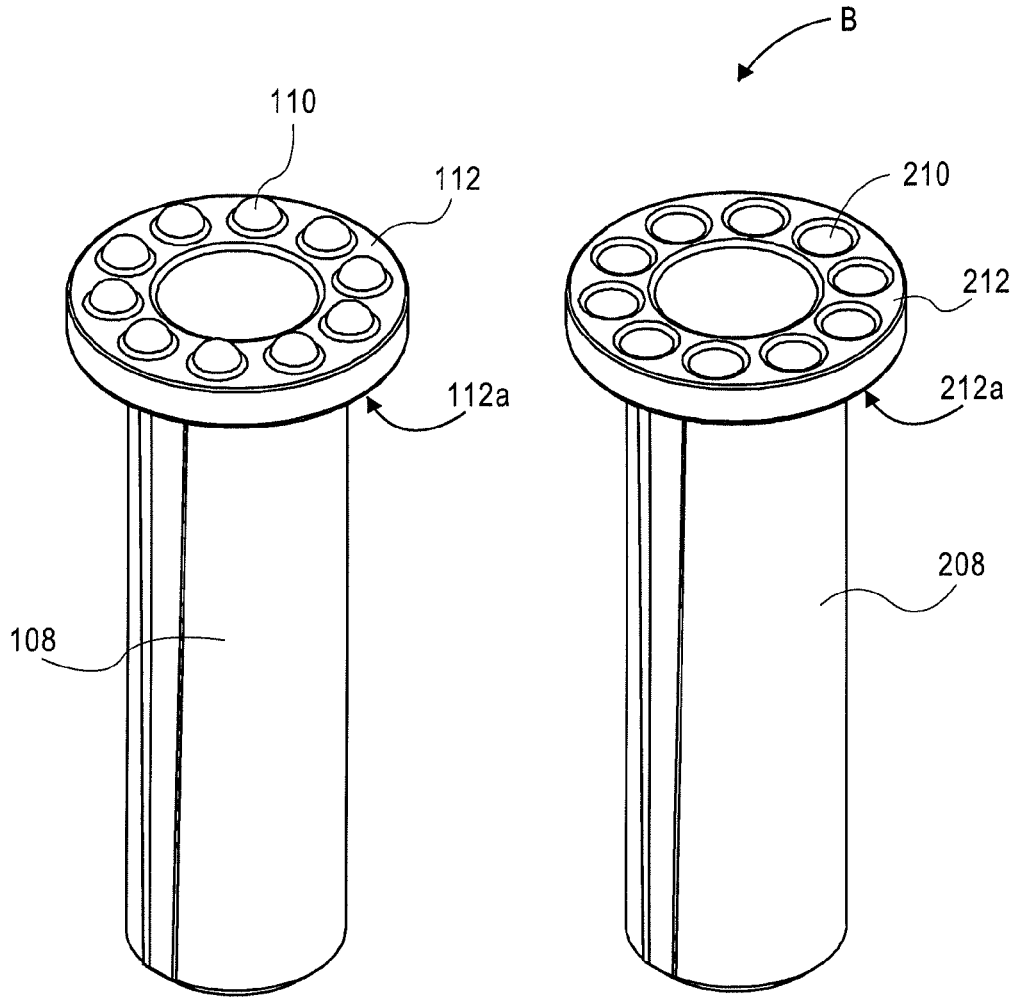
FIG. 3 is an enlarged perspective view of a bushing system of the positionable hinge of FIG. 1.

FIG. 3 depicts a bushing system B that may be utilized in the positionable hinge described herein. In the depicted embodiment, the first bushing 108 includes a plurality of projections 110 that project substantially outward from an interface surface 112. The side 112*a* of the bushing opposite the interface surface 112 contacts an end surface 104*a* of the first barrel 104. Corresponding indentations 210 defined by the interface surface 212 are present on the second bushing 208. Additionally, the side 212*a* of the bushing opposite the interface surface 212 contacts an end surface 204*a* of the second barrel 204. The indentations 210 may be configured to substantially match the three-dimensional shape profile of the projections 110, or may simply be openings or gaps formed in the interface surface 212 to receive the projections 110. In certain embodiments, the projections and indentations may be formed directly in the end surfaces 104*a*, 204*a* of the respective barrels 104, 204 and no bushings may be utilized.

This may increase friction as the hinge is pivoted, but may be acceptable for hinges that are utilized for pivoting of light-weight panels and/or those hinges that are formed of appropriate materials.

Figure 4:
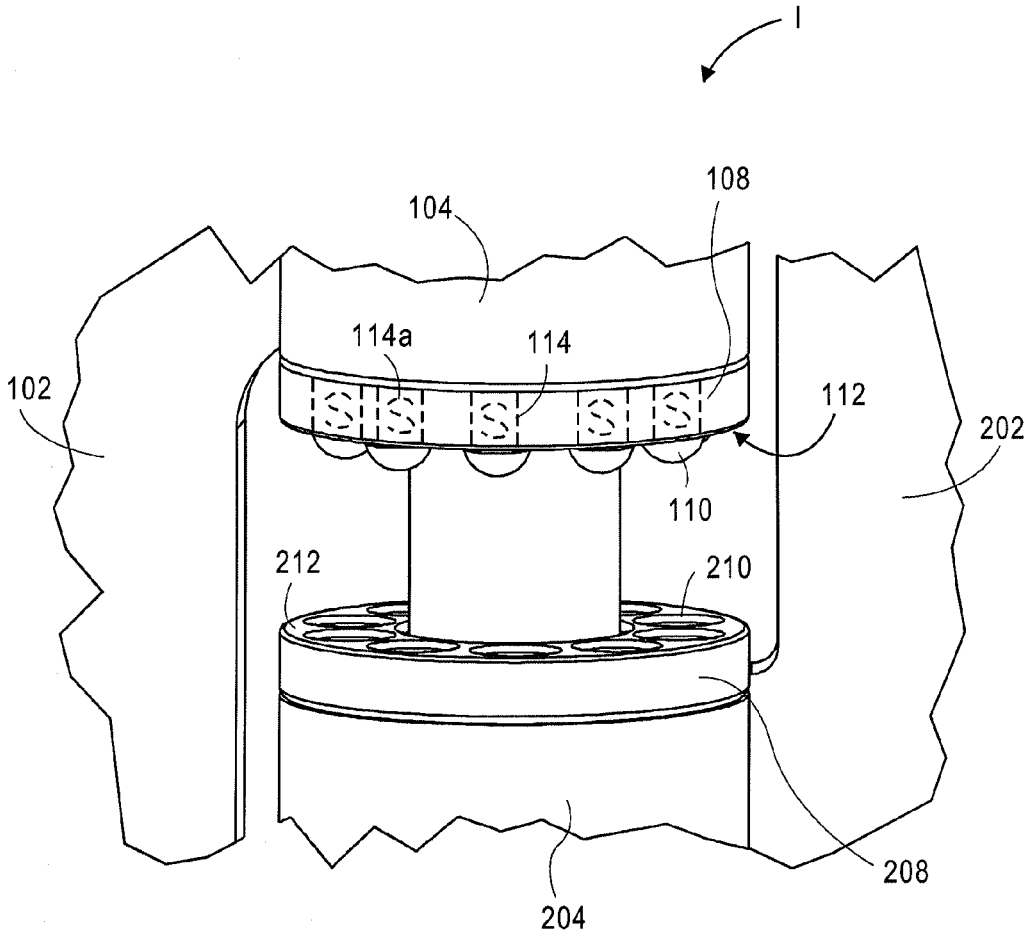
FIG. 4 is a partial enlarged perspective view of a barrel interface of the positionable hinge of FIG. 1.
Figure 5:
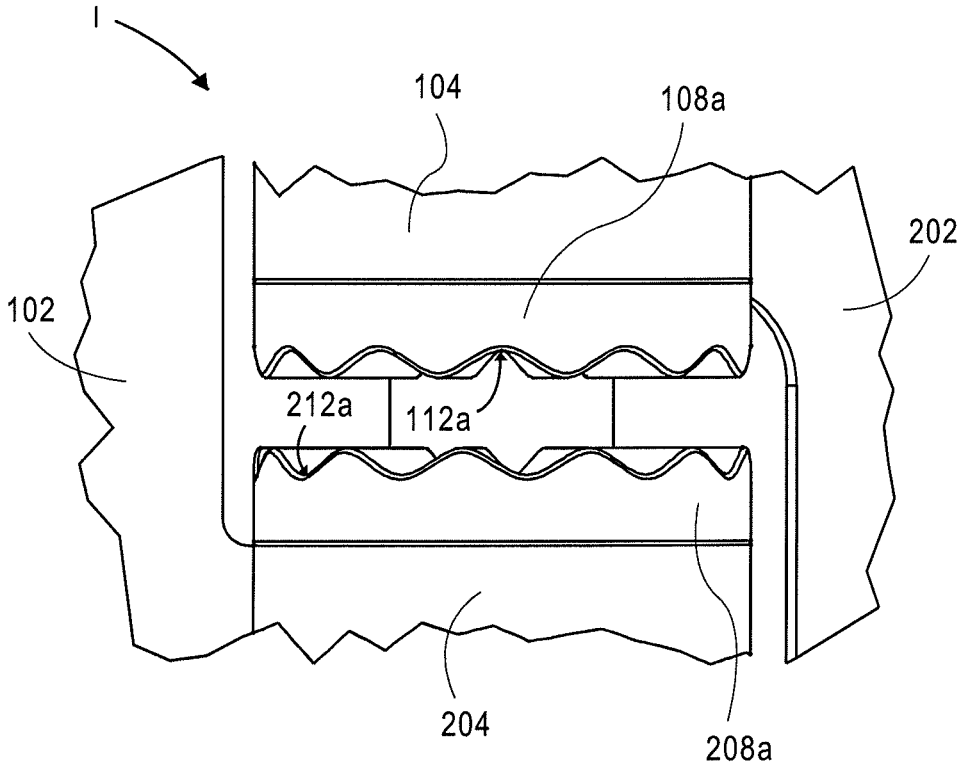
FIGS. 5 and 6 are partial enlarged side views of alternative barrel interfaces that may be utilized in a positionable hinge.
Figure 6:
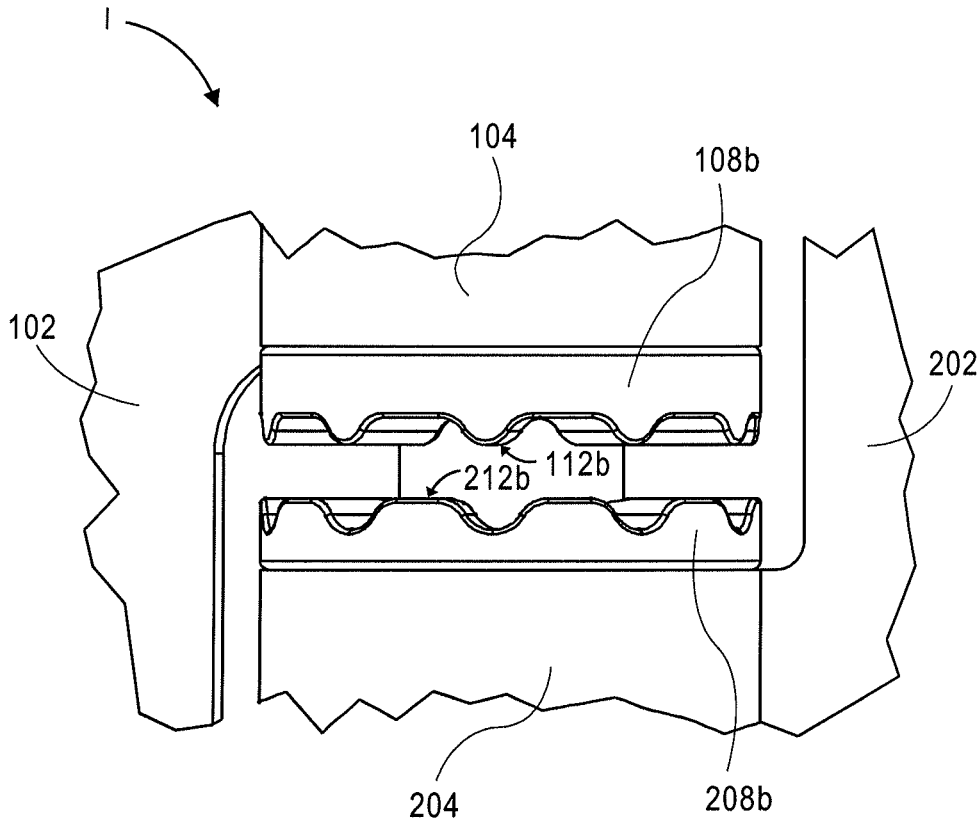

FIGS. 4-6 depict various embodiments of bushing systems may be utilized in a barrel interface I. The elements of the embodiment depicted in FIG. 4 are described above. FIG. 5 depicts bushings 108*a*, 208*a*, each having a serrated interface surface 112*a*, 212*a*. FIG. 6 depicts bushings 108*b*, 208*b*, each having a crenellated interface surface 112*b*, 212*b*. In these two embodiments, the interface surfaces of both bushings each form substantially similar or matching opposed textured mating surfaces. Again, as described above, any of the opposed textured surfaces may be formed directly in opposed surfaces of the barrels, if no bushings are used. In another embodiment, depicted in FIG. 4, first bushing 108 includes a number of bores 114 that each include a spring 114*a*. In this embodiment, interface surface 112 may be discrete from the first bushing 108. The projections 110 in this case may be ball bearings or similar elements that are biased into an projected position by the spring 114*a* located thereunder. The interface surface 112 may then be secured to the first bushing 108 to hold these spring-loaded projections 110 in position, allowing only for substantially vertical movement thereof. The interface surface 112 may be secured to the first bushing 108 with an interference fit or adhesive. Such a spring-loaded embodiment may provide additional holding force which may be desirable for certain applications. In another embodiment, a substantially circular leaf spring may be installed in a race within the first bushing 108 to bias a number of projections 110.

Figure 7A:
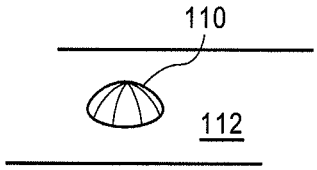
FIGS. 7A-7H are partial enlarged perspective views of projections that may be used with alternative barrel interfaces.
Figure 7B:
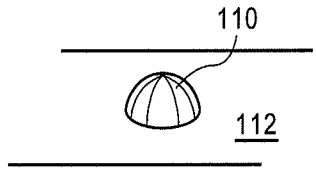
Figure 7C:
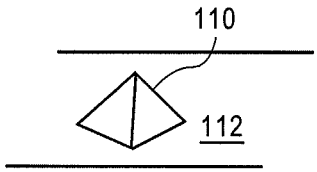
Figure 7D:
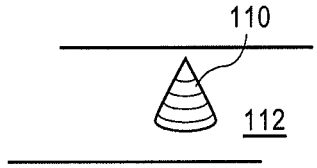
Figure 7E:
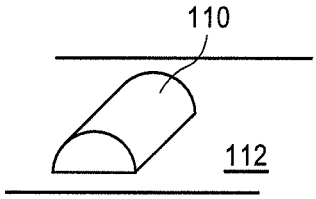
Figure 7F:
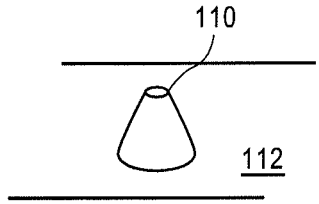
Figure 7G:
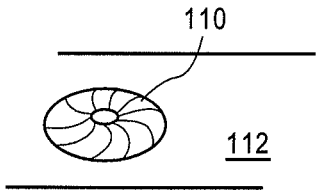
Figure 7H:
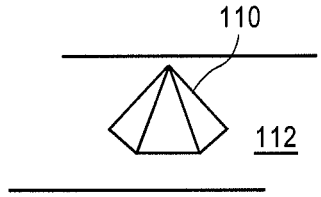

The profiles of the projections and indentations used in the opposed textured mating surfaces may be any shape useful for holding the hinge in place, while still allowing movement of the hinge upon application of a sufficient force. Perspective views of various projections are depicted in FIGS. 7A-7H. In each figure, the projection 110 projects from the interface surface 112. Exemplary projection shapes include a spherical cap (FIG. 7A), as depicted also in FIGS. 1-4, a hemisphere (FIG. 7B), a pyramid (FIG. 7C), a cone (FIG. 7D), a cylinder (FIG. 7E), a frustum (FIG. 7F), a torus (FIG. 7G), and a prism (FIG. 7H). In sum, the projections may correspond to any portion of any geometric shape. Additionally, the projections may be any shape, not just the defined geometric shapes listed above. The mating indentations for each of these shapes may correspond directly to the projection shape. Alternatively, an indentation may be a channel formed radially in the bushing, or may be an indentation of any shape or size to accommodate the projection.

Any number of projections and indentations may be utilized in the opposed textured mating surfaces, depending on the application. In some embodiments, the number of projections may correspond directly to the number of indentations, or the number of indentations may exceed the number of projections. An equal number of projections and indentations may be desirable, however, for proper load balancing of the projections as they are rotated against the interface surface of the second bushing from a first position to a second position. In certain embodiments, a first bushing having a single projection may be used with a second bushing having multiple indentations. Additionally, the number of projections/indentations may also be limited by the size of the bushings or hinge barrels (if formed on the ends of the barrels themselves). Regardless of the number of projections and indentations utilized, a hinged panel utilizing the positionable hinge disclosed herein generally will be held in place as a projection engages with a corresponding indentation (or, in the case of the serrated and crenellated surfaces depicted in FIGS. 5 and 6, as those matching surfaces mate). The generally low profile of the textured surfaces, however, will allow the hinge to be pivoted if acted upon by a sufficient force. An applied force of sufficient magnitude will rotate the surfaces out of a mating position (causing slight axial movement of, in this case, the first hinge section relative to the second hinge section), until the surfaces reengage in a different position.

The materials utilized in the manufacture of the hinge 10 may be those typically utilized for hinge manufacture, e.g., zinc, steel, brass, stainless steel, etc. Material selection for most of the components may be based on the proposed use of the hinge 10. Appropriate materials may be selected for hinges used on particularly heavy door panels, as well as on hinges subject to certain environmental conditions (e.g., moisture, corrosive atmospheres, etc.). For particularly light-weight door panels (for example, cabinet door panels), molded plastic, such as PVC, polyethylene, etc., may be utilized for the various components. Nylon, acetal, Teflon®, or combinations thereof may be utilized for the bushings to reduce friction, although other low-friction materials are contemplated. Threaded or press fit metal or nylon caps to secure the pin 12 in place also may be used.

The terms first, second, upper, lower, top, bottom, panel, jamb, etc., as used herein, are relative terms used for convenience of the reader and to differentiate various elements of the hinge 10 from each other. In general, unless otherwise noted, the terms are not meant to define or otherwise restrict location of any particular element. For example, the first hinge section 100 may be secured to the panel and the second hinge section 200 may be secured to the jamb, or vice-versa. Alternatively, the hinge 10 could be used with the barrels 104, 204, and pin 12 oriented horizontally. Additionally, either leaf may also form multiple barrels, if desired for a particular application. Such an application, however, would likely require additional spacing at the barrel interfaces to allow for axial movement of the barrels as the opposed textured mating surfaces engage and disengage. In such an embodiment, the specialized bushings described herein may be used on one barrel interface, with flexible bushings used between the remaining barrel interfaces, to allow for axial movement thereof.

While there have been described herein what are to be considered exemplary and preferred embodiments of the present technology, other modifications of the technology will become apparent to those skilled in the art from the teachings herein. The particular methods of manufacture and geometries disclosed herein are exemplary in nature and are not to be considered limiting. It is therefore desired to be secured in the appended claims all such modifications as fall within the spirit and scope of the technology. Accordingly, what is desired to be secured by Letters Patent is the technology as defined and differentiated in the following claims, and all equivalents.

What is claimed is:

1. A hinge comprising:

a first section comprising:

a first leaf; and a first hinge barrel secured to the first leaf, the first hinge barrel comprising a first barrel surface and a first bushing comprising a first textured surface and an interface surface in contact with the first hinge barrel;

a second section comprising:

a second leaf; and a second hinge barrel secured to the second leaf, the second hinge barrel comprising a second barrel surface and a second bushing comprising a second textured surface and an interface surface in contact with the second hinge barrel a hinge pin inserted into the first hinge barrel and the second hinge barrel, so as to align the first hinge barrel and the second hinge barrel, wherein when the first leaf is rotated about the hinge pin, contact between the first textured surface and the second textured surface causes axial movement of the first leaf relative to the second leaf; and a cap secured to a portion of the first hinge barrel opposite the bushing, wherein the cap prevents axial movement of the hinge pin out of the first hinge barrel.

2. The hinge of claim 1, wherein the hinge pin defines a pivot axis.

3. The hinge of claim 2, wherein the first textured surface and second textured surface are positioned off of the pivot axis.

4. The hinge of claim 1, wherein at least one of the first textured surface and the second textured surface comprises at least one of a spherical cap, a hemisphere, a pyramid, a cone, a cylinder, a frustum, a portion of a torus, and a portion of a prism.

5. The hinge of claim 1, wherein at least one of the first textured surface and the second textured surface comprises a serration.

6. The hinge of claim 1, wherein at least one of the first textured surface and the second textured surface comprises a crenellation.

7. The hinge of claim 1, wherein at least one of the first textured surface and the second textured surface comprises a spring-biased projection.

8. The hinge of claim 1, wherein each of the first hinge barrel and the second hinge barrel comprise a slot and each of the first bushing and the second bushing comprise a keyway for engaging the respective slot.

9. A hinge comprising:

a first section adapted to be secured to a pivotable panel, the first section comprising a first bushing in contact with the first section;

a second section adapted to be secured to a frame, the second section comprising a second bushing in contact with the second section;

a means for fixing a position of the first section relative to the second section;

a hinge pin for joining the first section and the second section, wherein a disengagement of the means for fixing causes axial movement of the first section along a hinge pin axis; and a cap secured to the first section, wherein the cap prevents axial movement of the hinge pin out of the first section.

10. The hinge of claim 9, wherein the means for fixing comprises:

at least one of a spherical cap, a hemisphere, a pyramid, a cone, a cylinder, a frustum, a portion of a torus, and a portion of a prism on at least one of the first bushing; and an indentation on the second bushing.

11. The hinge of claim 9, wherein the means for fixing comprises substantially similar serrated surfaces on each of the first bushing and the second bushing.

12. The hinge of claim 9, wherein the means for fixing comprises substantially similar crenellated surfaces on each of the first bushing and the second bushing.

13. The hinge of claim 9, wherein the first bushing comprises a keyway for engagement with a slot defined by the first section, and the second bushing comprises a keyway for engagement with a slot defined by the second section.

* * * * *